United States Patent [19]

Brussalis et al.

[11] Patent Number: 5,026,298

[45] Date of Patent: Jun. 25, 1991

[54] ELECTRICAL CONNECTOR WITH CONNECTOR POSITION ASSURANCE DEVICE

[75] Inventors: Stacy A. Brussalis, Niles; Jeffrey W. Heston, Warren; Stewart L. Yang, Cortland, all of Ohio

[73] Assignee: General Motors Corporation, Detroit, Mich.

[21] Appl. No.: 556,683

[22] Filed: Jul. 23, 1990

[51] Int. Cl.[5] ..... H01R 13/627

[52] U.S. Cl. ..... 439/358; 439/352

[58] Field of Search ..... 439/357, 350–356, 439/358, 347

[56] References Cited

U.S. PATENT DOCUMENTS

| | | | |
|---|---|---|---|
| 4,370,013 | 1/1983 | Niitsu et al. | 339/82 |
| 4,433,888 | 2/1984 | Winger | 439/357 |
| 4,634,204 | 1/1987 | Detter et al. | 339/91 R |
| 4,708,413 | 11/1987 | Schroeder | 439/358 |
| 4,711,507 | 12/1987 | Noorily | 439/347 |
| 4,746,306 | 5/1988 | Yurtin et al. | 439/357 |
| 4,801,275 | 1/1989 | Ikeda et al. | 439/358 |
| 4,906,204 | 3/1990 | Metzger | 439/352 |
| 4,946,395 | 8/1990 | Cope et al. | 439/352 |
| 4,946,404 | 8/1990 | Takenouchi et al. | 439/357 |
| 4,950,179 | 8/1990 | Takenouchi et al. | 439/357 |

*Primary Examiner*—Gary F. Paumen
*Assistant Examiner*—K. Carroll
*Attorney, Agent, or Firm*—Francis J. Fodale

[57] ABSTRACT

An electrical connector comprising matable electrical plug and socket connectors includes a primary lock for locking the electrical connectors in a fully mated position and a connector position assurance device for assuring that the electrical connectors are fully mated. The connector position assurance device is slideably mounted on the electrical socket connector and includes a resilient lock arm that cooperates with a lock projection of the electrical plug connector to provide a redundant primary lock if the electrical connectors are fully mated. When the electrical connectors are partially mated the connector position assurance device will either fully mate the electrical connectors and lock them together or push them apart depending upon the degree of partial mating.

10 Claims, 2 Drawing Sheets

ELECTRICAL CONNECTOR WITH CONNECTOR POSITION ASSURANCE DEVICE

BACKGROUND OF THE INVENTION

This invention relates generally to electrical connectors and more specifically to electrical connectors having connector position assurance devices to assure that mating connectors are properly mated and locked together.

Electrical connectors which have such devices are already known in the prior art.

U.S Pat. No. 4,370,013 issued to Mitsugi Niitsu et al Jan. 25, 1983 shows a connector device for electric circuit comprising male and female connector housings which are locked together by a flexible tongue piece of one connector housing engaging a cross piece of the other connector housing. When the connector housings are fastened, an insertion piece is inserted below the cross piece between the flexible tongue piece and the connector housing of the cross piece to prevent disengagement of the flexible tongue piece from the cross piece.

U.S. Pat. No. 4,746,306 issued to John A. Yurtin et al May 24, 1988 shows an electrical connector comprising dielectric connector bodies which are coupled and locked together by a resilient lock member of one connector body which engages a lock member of the other connector body to form a gauge hole. The gauge hole receives a gauge pin if the connector bodies are properly mated and locked together.

U.S. Pat. No. 4,634,204 issued to Gary C. Detter et al Jan. 6, 1987 shows an electrical connector comprising male and female connectors which are locked together by a flexible lock arm of one connector engaging a cross piece of the other connector. When the connectors are mated, a connector position assurance and assist device is inserted axially along a tracked slot beneath the flexible lock arm to assure proper mating and prevent disengagement of the flexible latch arm from the cross piece. If the connectors are only partly mated, the connector position assurance and assist device either assists the connectors to become fully mated or pushes them apart depending on which connector the device is inserted into.

U.S. Pat. No. 4,708,413 issued to Diane M. Schroeder Nov. 24, 1987 shows an electrical connector for electric circuit comprising a pair of matable connector bodies locked together with a pump handle type of lock which is disabled by a connector position assurance device when the connector bodies are properly mated. This connector position assurance device also pushes partially mated connector bodies together.

U.S. Pat. No. 4,906,204 issued to John R. Metzger Mar. 6, 1990 discloses an electrical connector comprising a male connector body having a rigid cantilevered lock arm which slides into a track portion of a female connector body. The female connector body has a flexible internal latch arm which engages the rigid lock arm to lock the connector bodies together. A connector position assurance device slides in a gauge slot of the female connector body only if the connected bodies are properly engaged and the internal flexible latch arm is fully engaged with the rigid latch arm.

U.S. Pat. No. 4,946,395 issued to Ken Cope, Ray Maga and Ted Hall Aug. 7, 1990 discloses an electrical connector comprising a first connector body and a second connector body which has a flexible lock arm which engages a lock shoulder of the first connector body when the first and second connector bodies are mated. The electrical connector includes a connector position assurance device which is slideably retained on the second connector body for movement between a release position where the flexible lock arm is free to flex into and out of engagement with the lock shoulder of the first connector body and a lock position where the connector position assurance device prevents the flexible lock arm from flexing out of engagement with the lock shoulder.

SUMMARY OF THE INVENTION

The object of this invention is to provide an electrical connector comprising mating connectors which have an improved and unique means for assuring that the connectors are fully mated and locked together.

A feature of the invention is that the connector position assurance device also acts as a redundant primary lock thereby insuring that the electrical connectors remain locked together in the event that the primary lock is destroyed.

Another feature of the invention is that the connector position assurance device is a separate entity that locks the electrical connectors together independently of the locking function of the primary lock.

Still another feature of the invention is that the connector position assurance device either completes mating of partially mated electrical connectors or pushes the partially mated electrical connectors apart when the connector position assurance device is pushed in the mating direction of the electrical connectors.

Still another feature of the invention is that the connector position assurance device cannot be fully preassembled to one connector prior to the connectors being fully mated.

Still yet another feature of the invention is that the connector position assurance device maintains a low profile.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
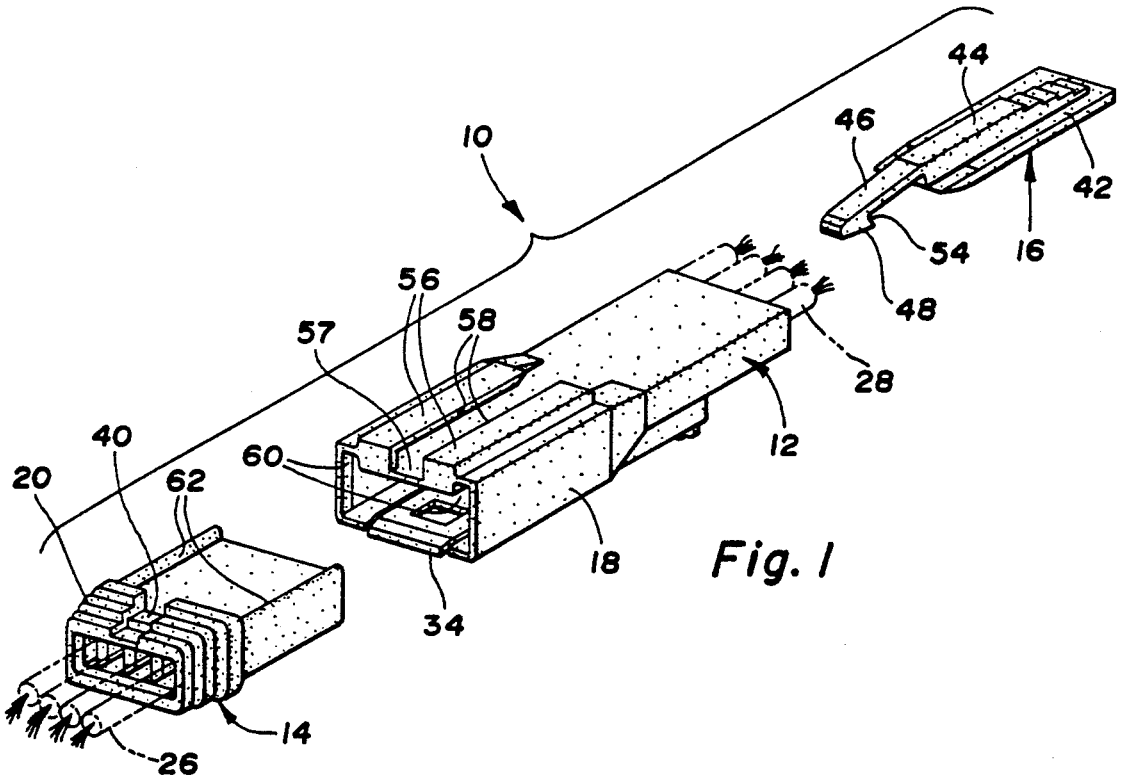
FIG. 1 is an exploded perspective view of an electrical connector comprising matable plug and socket electrical connectors which include a connector position assurance device in accordance with this invention.

Referring now to the drawing, an electrical connector 10 in accordance with this invention comprises matable electrical connectors 12 and 14 and a connector position assurance device 16.

Figure 2:
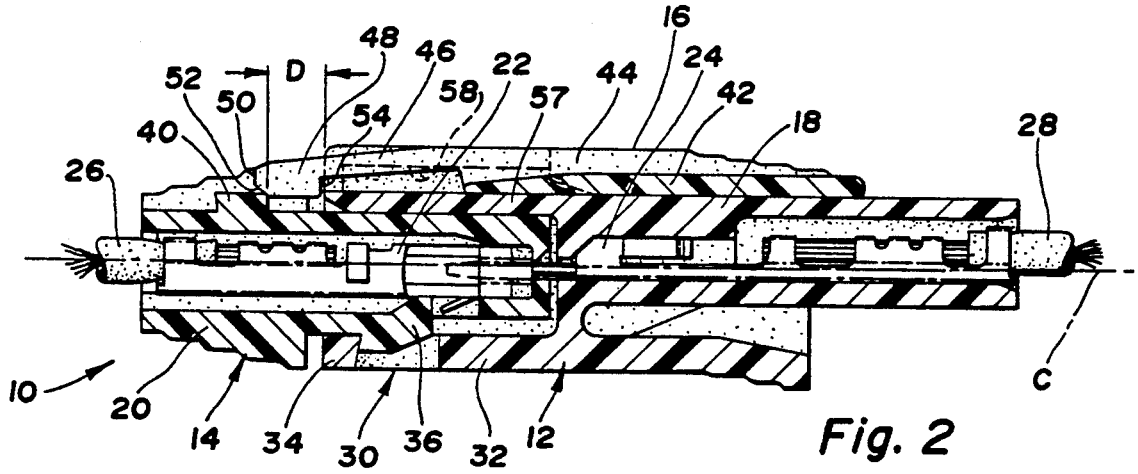
FIG. 2 is a longitudinal section showing the electrical plug and socket connectors of FIG. 1 locked in the fully mated position by a primary lock with the connector position assurance device in the process of being assembled to the connectors.
Figure 3:
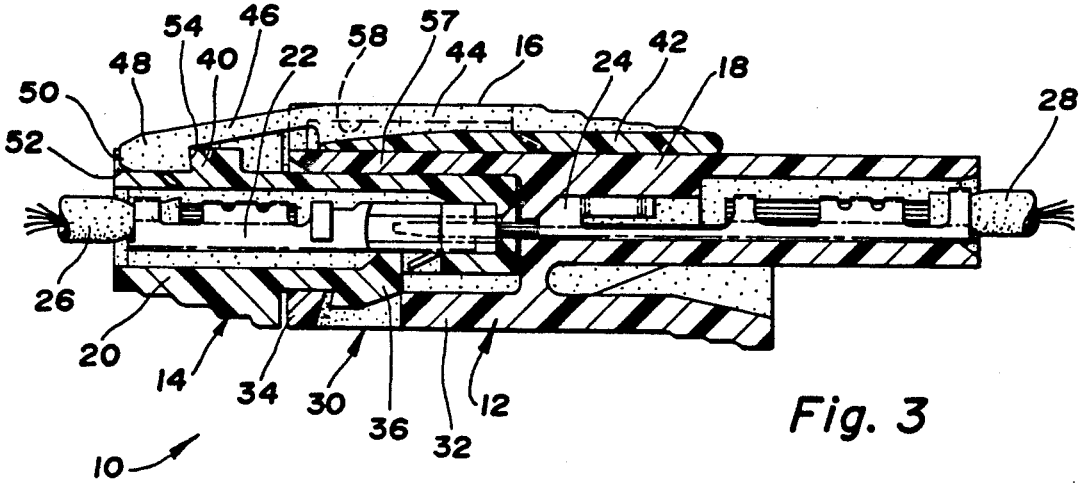
FIG. 3 is a longitudinal section showing the electrical plug and socket connectors of FIG. 1 locked in the mated position by a primary lock with the connector position assurance device engaged to insure that the connectors are fully engaged and to provide a redundant primary lock.

The matable electrical connectors 12 and 14 respectively include a socket connector body 18 and a plug connector body 20 of thermoplastic or other suitable electrically insulative material. The connector bodies 18 and 20 each house a number of electrical terminals 22 and 24 respectively that are attached to electric cables 26 and 28. Each of the terminals 22 mates to one of the terminals 24 when the electrical connector 12 is plugged onto the electrical connector 14 as shown in FIGS. 2 and 3.

The electrical connectors 12 and 14 are locked in the fully mated position by a primary lock indicated generally at 30 that comprises a flexible lock arm 32 which is pivotally attached to the socket connector body 18 midway between it ends in the manner of a pump handle. This flexible lock arm 32 has a slot at one end which forms a lock bar 34 which rides over and engages a lock ramp 36 of the plug connector body 20 when the connector bodies 18 and 20 are mated. The primary lock 30 is disengaged by depressing the end of the flexible lock arm 32 or pump handle which is at the opposite end of the lock bar 34.

The electrical connector 10 further includes a connector position assurance means that assures that the electrical connectors 12 and 14 are fully mated and that also provides a redundant primary lock. This connector assurance means comprises the connector position assurance device 16 that slideably mounts on the socket connector body 18 and a cooperating lock projection 40 of the plug connector body 20.

The connector position assurance device 16 comprises a generally flat slide 42 and a slat 44 that is integrally attached to the top of the slide 42 so that the slat 44 provides a resilient, i.e. elastic lock arm 46 that projects forwardly of the slide 42. The resilient lock arm 46 inclines downwardly and terminates in an enlargement 48 at its forward end.

The enlargement 48 includes a forward facing surface comprising an upper abutment 50 and a lower cam 52, and a rearward facing lock shoulder 54. The abutment 50 is preferably flat and perpendicular to the slide 42 which slides parallel to the longitudinal axis or centerline C of the connector body 18 which also corresponds to the line of action of the connector bodies during connector mating. The lower cam 52 inclines downwardly and rearwardly with respect to the slide 42 and the longitudinal axis. The rearwardly facing lock shoulder 54 is generally perpendicular to centerline C, but preferably includes a small back angle for a securer engagement with an identically angled back face of lock projection 40 of the plug connector body 20. The front face of the lock projection 40 is preferably flat and perpendicularly disposed to match the abutment 50.

The socket connector body 18 has two laterally spaced embossments 56 on the side 57 of the socket connector body 18 that is opposite the side containing the lock arm 34. The laterally spaced embossments 56 form blind ended slots 58 which are used to slideably mount the connector position assurance device 16. The connector position assurance device 16 is assembled to the socket connector body 18 after the electrical connectors 12 and 14 are mated as shown in FIG. 2, by inserting the opposite edges of the slide 42 into the open ends of the blind ended slots 58. The connector position assurance device 16 is then slid forward on the socket connector body 18 that is, toward the plug connector body 20 or in other words in the mating direction. It should be noted at this point that the rearward end of the slat 44 descends in stair-like fashion to provide a slip free thumb pad which facilitates sliding the connector position assurance device 16 forward in the slots 58.

When the connector position assurance device 16 is assembled to the socket connector body 18 in this manner, the enlargement 48 initially engages and slides along the side 57 until the enlargement 48 runs off the front edge of the side 57 as shown in FIG. 2. The size of the enlargement 48 in combination with the incline of the lock arm 46 is such that the free end of the resilient lock arm 46 (which includes the enlargement 48) is deflected upwardly so that the enlargement 48 is biased into engagement with the side 57 during its movement along the side 57. When the enlargement 48 runs off the front edge of the side 57, the enlargement 48 drops down and hooks over the front edge under the self biasing force of the resilient lock arm 46 as it moves toward its free unbiased state. The lock projection 40 is located on the plug connector body 20 so the front edge of the lock projection 40 is located a predetermined distance D from the front edge of the side 57 when the electrical connectors 12 and 14 are fully engaged and locked together in the fully engaged position by the primary lock 30 as shown in FIG. 2. As noted in FIG. 2, the enlargement 48 falls into the gap provided by this spacing of the front edges as soon as the enlargement 48 runs off the front edge of the side 57. When the enlargement 48 falls into the gap, the lower cam 52 on the forward face of the enlargement 48 engages the front edge of the lock projection 40 so that the enlargement 48 rides over the projection 40 to the position shown in FIG. 3 in response to continued sliding of the connector position assurance device 16 in the forward direction. FIG. 3 shows the final position of the connector position assurance device 16 where the lock shoulder 54 of the connector position assurance device 16 is engaged behind the lock projection 40. This locked position of the connector position assurance device 16 indicates that the electrical connectors 12 and 14 are fully engaged. The connector position assurance device 16 preferably has a color which is quite distinct from the color or colors of the connector bodies 18 and 20 to enhance visual recognition of the locked position of connector position assurance device 16.

A feature of the invention is that the connector position device 16 when it is locked in the position shown in FIG. 3 also provides a redundant primary lock which keeps the electrical connectors 12 and 14 locked together should the primary lock 30 fail for one reason or another.

Another feature of the invention is that the connector position assurance device 16 either completes mating of partially mated electrical connectors 12 and 14 or else it pushes the partially mated electrical connectors 12 and 14 apart when the connector position assurance device 16 is pushed in the mating direction of the electrical connectors.

This alternative reaction depends upon distance between the front edge of the lock projection 40 and the front edge of the connector body side 57 which determines the size of the gap that enlargement 48 falls into as it falls off the front edge of the connector body side 57.

Figure 4:
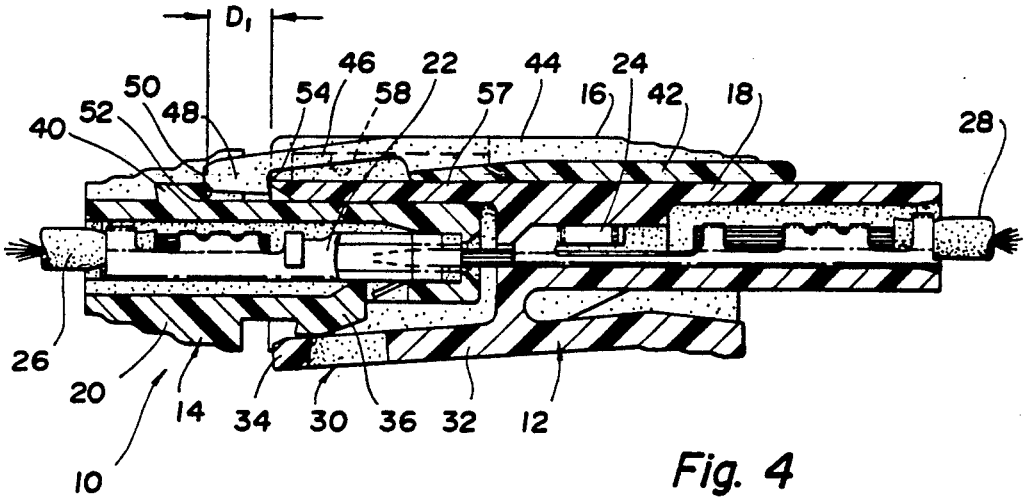
FIG. 4 is a longitudinal section showing the electrical plug and socket connectors of FIG. 1 partially mated with the connector position assurance device in the process of being assembled to the connectors to complete mating of the connectors.

When the electrical connectors 12 and 14 are only partially engaged, the distance between the front edge of the lock projection 40 and the front edge of the connector body side 57 increases enlarging the size of the gap which enlargement 48 falls into as it falls off the front edge of the connector body side 57. However, the connector position assurance device 16 completes the mating of the partially mated electrical connectors 12 and 14 so long as this distance does not exceed a predetermined maximum distance D-1 which is illustrated in FIG. 4.

In this condition, the lower cam 52 of the enlargement 48 still engages the front edge of the lock projection 40 even though the electrical connectors 12 and 14 and the primary lock 30 are not fully engaged. Consequently continued sliding movement of the connector position assurance device 16 in the forward direction, that is, toward the left as viewed in FIG. 4, still causes the enlargement 48 to ride over the lock projection 40 to the position shown in FIG. 3. Moreover during the final stages of this continued sliding movement, the front edge of the slide 42 engages the front walls of the blind ended slots 58 so that the connector position assurance device 16 pushes the socket connector body 18 into a fully mated engagement with the plug connector body 20 before enlargement 48 drops down behind the lock projection 40 to lock the connector position assurance device 16 in place as shown in FIG. 3.

Figure 5:
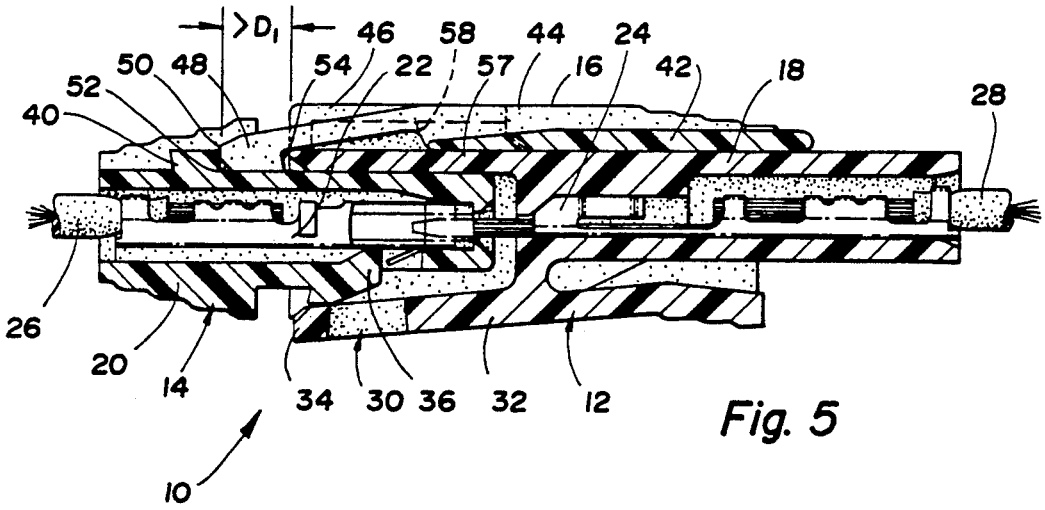
FIG. 5 is a longitudinal section showing the electrical plug and socket connectors of FIG. 1 partially mated with the connector position assurance device in the process of being assembled to the connectors to push the partially mated connectors apart.
Figure 6:
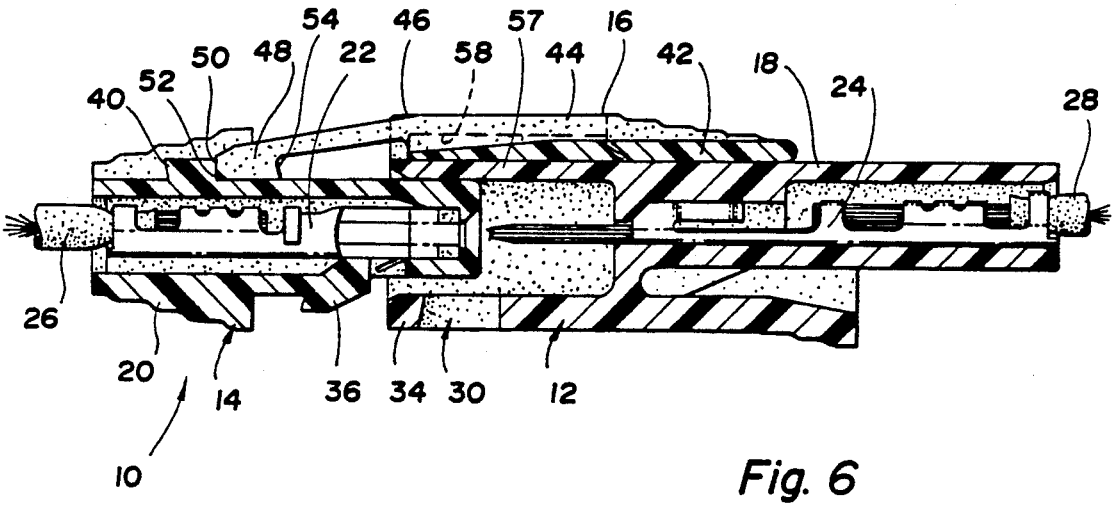
FIG. 6 is a longitudinal section showing the electrical plug and socket connectors of FIG. 1 pushed apart as a result of the electrical connectors being only partially mated when the connector position device is assembled to the partially engaged connectors.

On the other hand, if the distance between the front edge of the lock projection 40 and the front edge of the connector body side 57 exceeds the predetermined maximum distance D-1 which is illustrated in FIG. 5, the connector position assurance device 16 will push the partially engaged electrical connectors 12 and 14 apart as shown in FIG. 6. In this instance the abutment 50 rather than the lower cam 52 of the enlargement 48 engages the front of the lock projection 40. Consequently continued sliding movement of the connector position assurance device 16 in the forward direction, that is, toward the left as viewed in FIG. 5, now causes the enlargement 48 to push the lock projection 40 and the electrical connector 14 away from the electrical connector 12 to the position shown in FIG. 6 where the slide 42 is bottomed out in the blind ended slots 58. Moreover, the connector position assurance device 16 cannot be fully preassembled to the electrical connector 12 prior to the electrical connectors 12 and 14 being fully mated because the connector position assurance device 16 will prevent mating of the electrical connectors 12 and 14 as shown in FIG. 6.

It should also be noted that the connector position assurance device 16 maintains the low profile of the electrical connectors 12 and 14 as the connector position assurance device 16 and embossments 56 increase the height of the electrical connectors 12 and 14 hardly at all. This is particularly so in the illustration where the connector position assurance device 16 and embossments 56 are fitted between indexing slots 60 of the electrical connector 12 which receive indexing ribs 62 of the electrical connector 14.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector comprising;

a first electrical connector and a second electrical connector which each include electrical terminals which mate when the electrical connectors are mated, and connector position assurance means for assuring that the electrical connectors are fully mated, comprising a connector position assurance device that slideably mounts on the first electrical connector and a cooperating lock projection of the second electrical connector, the connector position assurance device comprising a slide and a resilient lock arm that is integrally attached to the slide, the resilient lock arm having an enlargement at its free forward end that includes a forward facing abutment and cam and a rearward facing lock shoulder, the cam engaging the cooperating lock projection of the second electrical connector and camming the enlargement over the lock projection so that the lock shoulder engages behind the lock projection to lock the electrical connectors in a mated position when the connector position assurance device is slid forwardly on the first electrical connector and the lock projection is located within a predetermined maximum distance from the first electrical connector, and the abutment engaging the lock projection and pushing the electrical connectors apart when the connector position assurance device is slid forwardly on the first electrical connector and the lock projection is located at a distance from the first electrical connector that exceeds the predetermined maximum distance.

2. The electrical connector as defined in claim 1 further including a primary lock for locking the electrical connectors in a fully mated position, and wherein the connector position assurance means provides a redundant primary lock when the lock shoulder engages behind the lock projection.

3. The electrical connector as defined in claim 2 wherein the primary lock and the redundant primary lock are located on opposite sides of the electrical connectors.

4. The electrical connector as defined in claim 1 wherein the first electrical connector has slots on one side thereof which receive the slide for slideably mounting the connector position assurance device on the first electrical connector, and wherein the resilient lock arm is deflected outwardly at the free end when the slide is inserted into the slots so that the enlargement at the free forward end of the resilient lock arm biasingly engages the one side when it is slid forwardly on the first electrical connector.

5. The electrical connector as defined in claim 4 wherein the resilient lock arm projects forwardly and downwardly of the slide.

6. The electrical connector as defined in claim 5 wherein the slots on the one side of the first connector are blind ended to provide front walls that stop forward movement of the connector position assurance device relative to the first electrical connector.

7. An electrical connector comprising;

a first electrical connector and a second electrical connector which include mating electrical terminals when the electrical connectors are mated, a primary lock for locking the electrical connectors in a fully mated position, and connector position assurance means for assuring that the electrical connectors are fully mated comprising a connector position assurance device that slideably mounts on one side of the first electrical connector and a cooperating lock projection of the second electrical connector, the connector position assurance device comprising a slide and a slat which is integrally attached to the top of the slide so as to provide a resilient inclined lock arm that projects forwardly and downwardly of the slide, the resilient inclined lock arm having an enlargement at its free forward end that includes a forward facing surface comprising an upper abutment and a lower cam, and a rearward facing lock shoulder, the resilient lock arm being deflected outwardly at the free end when the slide is slideably mounted on the first electrical connector so that the enlargement at the free forward end of the resilient lock arm biasingly engages the one side when it is slid forwardly on the first electrical connector, the lower cam engaging the cooperating lock projection of the second electrical connector and camming the enlargement over the lock projection so that the lock shoulder engages behind the lock projection to lock the electrical connectors in a mated position providing a redundant primary lock when the connector position assurance device is slid forwardly on the first electrical connector and the lock projection is located within a predetermined maximum distance from a forward edge on the one side of the first electrical connector, and the upper abutment engaging the lock projection and pushing the electrical connectors apart when the connector position assurance device is slid forwardly on the first electrical connector body and the lock projection is located at a distance from the forward edge on the one side of the first electrical connector that exceeds the predetermined maximum distance.

8. The electrical connector as defined in claim 7 wherein the primary lock and the redundant primary lock are located on opposite sides of the electrical connectors.

9. The electrical connector as defined in claim 7 wherein the first electrical connector has blind ended slots on the one side which receive the slide for slideably mounting the connector position assurance device on the first electrical connector, and wherein the blind ended slots provide walls that stop forward movement of the connector position assurance device relative to the first electrical connector.

10. The electrical connector as defined in claim 8 wherein the first electrical connector has blind ended slots on the one side which receive the slide for slideably mounting the connector position assurance device on the first electrical connector, and wherein the blind ended slots provide walls that stop forward movement of the connector position assurance device relative to the first electrical connector.

* * * * *